United States Patent [19]

Remondet

[11] Patent Number: 5,018,760

[45] Date of Patent: May 28, 1991

[54] SNOW SURFBOARD

[76] Inventor: Jean-Pierre Remondet, Chalet "Le Tournavel", Le Cret, 73150 Val D'Isere, France

[21] Appl. No.: 415,218

[22] PCT Filed: Jan. 18, 1989

[86] PCT No.: PCT/FR89/00011

§ 371 Date: Aug. 31, 1989

§ 102(e) Date: Aug. 31, 1989

[87] PCT Pub. No.: WO89/06560

PCT Pub. Date: Jul. 27, 1989

[30] Foreign Application Priority Data

Jan. 18, 1988 [FR] France ..... 88 00820

[51] Int. Cl.[5] ..... A63C 5/04

[52] U.S. Cl. ..... 280/609; 280/14.2; 441/65; 441/68

[58] Field of Search ..... 280/601, 602, 608, 609, 280/14.2; 441/65, 68, 74

[56] References Cited

U.S. PATENT DOCUMENTS

| | | | |
|---|---|---|---|
| 4,305,603 | 12/1981 | Müller et al. | 280/14.2 X |
| 4,405,139 | 9/1983 | Kawahard | 280/14.2 |
| 4,533,150 | 8/1985 | Hardy | 280/14.2 |
| 4,915,400 | 4/1990 | Chambers | 280/14.2 |

FOREIGN PATENT DOCUMENTS

| | | |
|---|---|---|
| 2557275 | 7/1977 | Fed. Rep. of Germany . |
| 2924023 | 12/1980 | Fed. Rep. of Germany . |
| 647415 | 1/1985 | Switzerland . |

*Primary Examiner*—David M. Mitchell
*Assistant Examiner*—Michael Mar
*Attorney, Agent, or Firm*—Browdy and Neimark

[57] ABSTRACT

A surfboard for surfing on snow has an hourglass profile including dimension lines curved inwardly in the runner zone, and wherein bindings each form an angle with a line perpendicular to the longitudinal axis of the surfboard. Both dimension lines are offset longitudinally with respect to each other and are positioned so that the most curved point of each dimension line is located on the axis of symmetry of the axes passing through the two bindings.

6 Claims, 1 Drawing Sheet

SNOW SURFBOARD

FIELD OF THE INVENTION

This invention pertains to a snow surfboard.

A surfboard is a board having the general structure of a ski, i.e., comprising a ski tip, a runner zone and a tail, the base being delimited laterally on the lower surface of the surfboard by two metal edges. As on a ski, the dimension lines, i.e., the lateral curve of the edges can vary depending on the intended characteristics of the surfboard. When the edges are curved to produce a board narrower in the middle than at the ends, a surfboard is said to have an "hourglass" profile. The more pronounced the hourglass profile, the easier it is to initiate a turn. On the other hand, a less-pronounced hourglass makes it more difficult to initiate turns, but makes it easier to handle the surfboard on hard snow at high speeds.

Both of the user's feet are secured on the surfboard in a longitudinally offset position with respect to each other. If the feet were initially secured parallel to each other and perpendicular to the axis of the surfboard, both feet are now turned slightly forward and diverge forward in order to conform to the natural position of a person's legs. If this position improves comfort and maneuvering capabilities, it does present the problem, in a surfboard having a fairly pronounced hourglass shape, that the user's center of gravity moves in front of the most curved part of the dimension line when edging forward, or behind the most curved part of the dimension line when edging backward. Consequently, the edge in question does not grip the snow uniformly, since the tail is not sufficiently weighted down in the former case, and the ski tip is not sufficiently weighted down in the latter. This is why most surfboards have only a slight hourglass profile.

Another problem beginners face in surfing is in initiating turns. Indeed, because the edges are located beyond the ends of the user's feet, it takes a hard push to incline the surfboard greatly in order to edge.

SUMMARY OF THE INVENTION

This invention aims to correct these problems.

To this end, the surfboard of the present invention is of the type comprising an hourglass profile, i.e., having dimension lines curved inward in the runner zone, and wherein the bindings each form an angle with a line perpendicular to the longitudinal axis of the surfboard. This surfboard is characterized in that both dimension lines are mutually offset longitudinally and are positioned such that the most curved point of each dimension line is on the axis of symmetry of the axes passing through the two bindings.

The result of this structure is that, regardless of whether the user pushes either of the edges forward or backward, his center of gravity moves through its maximum curve point, which gives the surfboard a perfect balance, so that the surfboard is not understood or oversteered.

Advantageously, the rear edge delimiting the tail is inclined with respect to the perpendicular to the longitudinal axis of the surfboard, the longitudinal edge located on the side behind the bindings being longer than the longitudinal edge on the side in front of the bindings by a value equal to the offsetting of the dimension lines.

In addition to the functional characteristics resulting from this structure, it gives the surfboard a totally pleasant unique appearance.

In practice, the two dimension lines are longitudinally offset about 5 cm.

According to another characteristic of the invention, this surfboard comprises two pairs of edges, i.e., the traditional outside edges, and two other edges, each parallel to one of the outside edges, placed closer than the outside edges to the longitudinal axis of the surfboard, under the user's feet, the plane containing the inside edges being under the plane containing the outside edges.

The inside edges placed under the user's feet make it possible to rock and press on an edge more easily than traditionally, so that turns can be initiated quickly, and beginners can learn to surf more easily, without hindering the capability of easy sideslipping. Moreover, on packed snow, the surfboard can be brought into a balanced position in which it rests on its two edges located on the same side before progressively increasing the angle and bringing the surfboard onto the outside edge, in curves negotiated at higher speeds.

Advantageously, two edges on the same side are about 55 mm apart, while they are vertically offset about 7 to 8 mm in the runner zone.

According to another characteristic of the invention, each base zone located between an outside edge and an inside edge is offset vertically with respect to the center part of the base and is inclined from inside to outside, as well as from the base to the upper surface of the surfboard.

BRIEF DESCRIPTION OF THE DRAWINGS

In any event, the invention will be understood clearly using the description that follows in reference to the attached schematic drawing representing one embodiment of this surfboard.

DETAILED DESCRIPTION OF THE INVENTION

Figure 1:
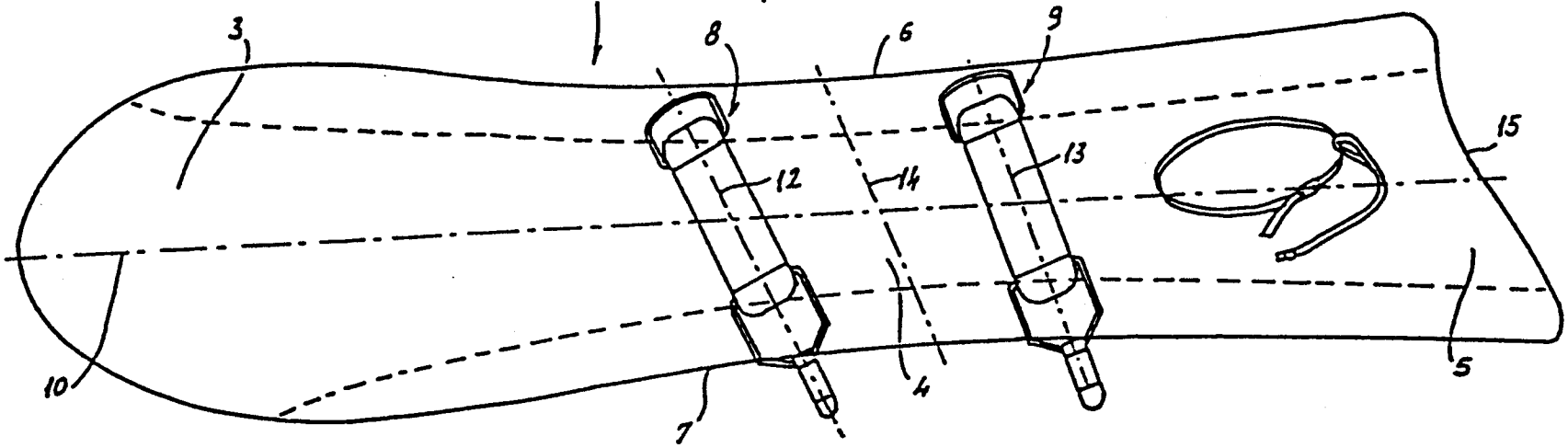
FIG. 1 is a top view.
Figure 3:
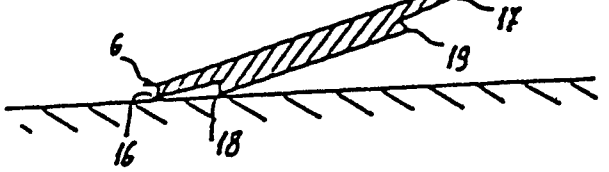
FIGS. 2 and 3 are two cross section views of the surfboard, respectively, flat and making a large-radius turn.
Figure 2:
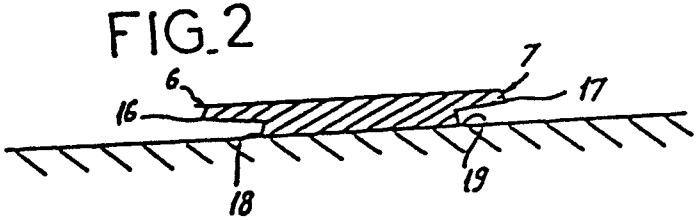
Figure 4:
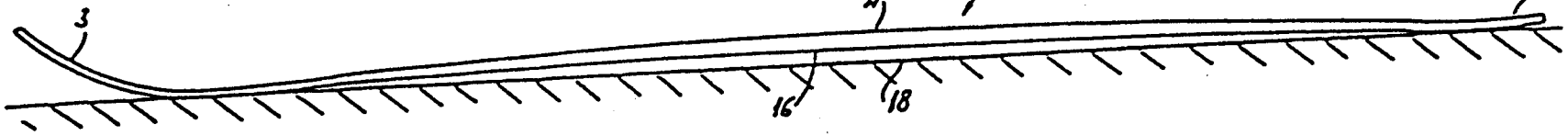
FIG. 4 is a side view.

The surfboard shown in the drawing and designated by general reference 2 comprises a ski tip 3, a runner zone 4 and a tail 5.

The surfboard has an hourglass profile, i.e., it comprises dimension lines 6 and 8 having a pronounced curve in their center part.

As the drawing shows, the surfboard is equipped in the known manner with two bindings for both the user's feet, designated with reference 8 for the front binding and 9 for the rear binding. The two bindings 8 and 9 are offset longitudinally and form an angle with a line perpendicular to the longitudinal axis 10 of the surfboard, respective axes 12 and 13 of said bindings 8 and 9 being turned slightly forward with respect to a line perpendicular to the longitudinal axis 10, the two axes 12 and 13 forming between themselves an angle slightly open towards the front, i.e., beside dimension line 6.

The two axes 12 and 13 of the two bindings 8 and 9 are thus symmetrical with respect to line 14, which is itself inclined with respect to the perpendicular to the longitudinal axis 10 of the surfboard.

As FIG. 1 shows, and according to the essential characteristics of the invention, the two dimension lines 6 and 7 are offset longitudinally from each other so that the maximum curve point of each dimension line 6, 7 is at the point at which line 14 intersects with the dimension line under consideration. In practice, the two dimension lines are longitudinally offset about 5 cm. Considering the different positions of the two dimension lines, the rear edge 15 delimiting the tail is inclined from front to back and the end of dimension line 6 towards the end of dimension line 7.

Because of this characteristic, when the user pushes at the level of dimension line 6, his center of gravity moves through the maximum curve point of this dimension line, so that the surfboard is perfectly balanced. Likewise, when the user edges on the edge corresponding to dimension line 7, his center of gravity moves through the maximum curve point of this dimension line, so that the surfboard is perfectly balanced, with no tendency towards oversteering or understeering.

According to another characteristic of the invention, this surfboard comprises two pairs of edges, i.e., the traditional outside edges 16 and 17 corresponding to dimension lines 6 and 7, and two inside edges 18 and 19, parallel respectively to edges 16 and 17 located in a plane under the plane containing edges 16 and 17, and located under the zone in which the user's feet press.

As the drawing shows, the base comprises a center part 20 and two side parts 22 offset vertically in the upward direction with respect to the center part by a value of 7 to 8 mm in the runner zone. The two edges 16, 18 and 17, 19 are laterally offset about 55 mm. As the result of this structure, depending on the location of edges 18 and 19 under the user's feet, it is easy to rock the surfboard on one of these edges to initiate a turn, finding a stable balanced position wherein the corresponding outside edge also presses on the snow. It is also possible to exceed this stable balanced position on two edges, to press only on the outside edge, as with a traditional surfboard. This structure makes it much easier to learn to surf, and to steer on packed snow, without detracting from lateral sideslipping capabilities.

As seen from the above, the invention contributes a great improvement to existing technology, by supplying a surfboard of a simple design, that remains perfectly balanced during turns on either edge, while making it possible to negotiate short-radius turns using an hourglass profile that can be very pronounced, and having a very attractive appearance.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

What is claimed is:

1. A snow surfboard comprising:

a planar upper surface, a lower surface, a front portion, a tail portion, and a runner zone between said front portion and said tail portion, said snow surfboard having an hourglass profile with a central longitudinal axis and longitudinally extending sidewalls forming dimension lines which are curved inwardly into the runner zone, the bottom of each of said sidewalls forming an outside edge with said lower surface;

a pair of bindings attached to said upper surface and being longitudinally spaced along said central longitudinal axis, each of said bindings having a longitudinal axis which extends at an angle from a point of intersection of said longitudinal axis with said central longitudinal axis such that a forward potion of each binding is located forwardly of a line extending perpendicular to said central longitudinal axis at said point of intersection;

wherein said dimension lines of said sidewalls are offset longitudinally with respect to each other and are positioned such that an innermost curved point of each said dimension line is located on an axis which extends between the longitudinal axes of said bindings and is parallel thereto.

2. A surfboard according to claim 1 wherein the tail portion is inclined with respect to a line perpendicular to said control longitudinal to the rear of the rear of the bindings, said longitudinal edge being longer than a longitudinal edge located on the side of the front of the bindings by a value equal to the offsetting of said dimension lines.

3. A surfboard according to claim 1 wherein said dimension lines are longitudinally offset by about 5 cm.

4. A surfboard according to claim 1 further including a pair of inner edges, said pair of inner extedning edges, parallel to said outside edges, said pair of inner edges being placed closer to said central longitudinal axis than said outside edges when the surfboard is under the feet of a user;

said pair of inner edges being located in a plane below a plane containing said outside edges.

5. A surfboard according to claim 4 wherein inner and outside edges along respective sides of said surfboard are spaced apart approximately 55 mm and are vertically offset by about 7–8 mm in the runner zone.

6. A surfboard according to claim 5 further including a base zone located between each outside edge and each inner edge, each base zone being offset vertically with respect to said plane containing said inner edges and each base zone being inclined inwardly each inner edge to a respective outer edge.

* * * * *